US012398532B2

(12) United States Patent
Crowson et al.

(10) Patent No.: US 12,398,532 B2
(45) Date of Patent: Aug. 26, 2025

(54) MARINE VESSELS AND METHODS OF USING SAME

(71) Applicant: WING MARINE LLC, Montgomery, TX (US)

(72) Inventors: John Crowson, Lovelady, TX (US); Mel Friedman, Montgomery, TX (US); Douglas W. Thompson, Amarillo, TX (US); Peter C. Crossland, Houston, TX (US)

(73) Assignee: WING MARINE LLC, League City, TX (US)

( * ) Notice: Subject to any disclaimer, the term of this patent is extended or adjusted under 35 U.S.C. 154(b) by 0 days.

(21) Appl. No.: 18/734,339

(22) Filed: Jun. 5, 2024

(65) Prior Publication Data

US 2025/0237036 A1 Jul. 24, 2025

Related U.S. Application Data

(60) Provisional application No. 63/622,729, filed on Jan. 19, 2024.

(51) Int. Cl.
*E02F 3/88* (2006.01)

(52) U.S. Cl.
CPC ..... *E02F 3/885* (2013.01)

(58) Field of Classification Search
CPC ..... E02F 3/885; E02F 3/8833; E02F 9/06
See application file for complete search history.

(56) References Cited

U.S. PATENT DOCUMENTS

| | | | | |
|---|---|---|---|---|
| 400,936 | A | 4/1889 | Morris | |
| 615,414 | A * | 12/1898 | Stead | E21B 7/122 175/9 |
| 1,477,679 | A | 12/1923 | Woolley | |
| 2,242,940 | A | 5/1941 | Caoli | |
| 3,010,232 | A | 11/1961 | Skakel et al. | |
| 3,036,393 | A | 5/1962 | Baird, Jr. | |
| 3,357,506 | A | 12/1967 | Bosredon | |
| 3,698,573 | A | 10/1972 | Wolters | |
| 3,762,078 | A | 10/1973 | Wetherbee | |

(Continued)

FOREIGN PATENT DOCUMENTS

| | | |
|---|---|---|
| EP | 0328198 A1 | 8/1989 |
| EP | 2084334 A1 | 8/2009 |

(Continued)

OTHER PUBLICATIONS

Eddy Pump Corporation, "Eddy Pump Specifications", pp. 1-5, downloaded from the Internet May 17, 2020, Eddy Pump Corporation, El Cajon, California (USA).

(Continued)

*Primary Examiner* — Jamie L McGowan
(74) *Attorney, Agent, or Firm* — Jeffrey L. Wendt; The Wendt Firm, P.C.

(57) ABSTRACT

Marine pump vessels and wing fluidizer support vessels, and methods of using same. Wing fluidizer support vessels are configured to deploy a wing fluidizer including thrusters capable of fluidizing sediments from a first seabed location and moving it to a second seabed location. Pump vessels include one or more pumps deployable from a separate vessel and stowable thereon.

14 Claims, 8 Drawing Sheets

(56) References Cited

U.S. PATENT DOCUMENTS

| | | | | |
|---|---|---|---|---|
| 3,845,865 | A * | 11/1974 | Campbell | B66C 23/52 212/311 |
| 3,889,403 | A | 6/1975 | Gauthier et al. | |
| 3,949,497 | A | 4/1976 | Crump | |
| 4,021,019 | A | 5/1977 | Sanders | |
| 4,250,034 | A | 2/1981 | Wolters | |
| 4,365,509 | A | 12/1982 | Comelis | |
| 4,373,278 | A | 2/1983 | Myrick | |
| 4,418,484 | A | 12/1983 | Wolters | |
| 4,429,476 | A | 2/1984 | Wakefield | |
| 4,574,501 | A | 3/1986 | Sloan | |
| 4,680,879 | A * | 7/1987 | Hill | E02F 3/9231 277/379 |
| 4,979,322 | A | 12/1990 | Sloan | |
| 5,020,858 | A | 6/1991 | Nishikawa | |
| 5,083,386 | A | 1/1992 | Sloan | |
| 5,275,733 | A | 1/1994 | Burnham | |
| 5,285,587 | A | 2/1994 | Krenzler | |
| 5,417,861 | A | 5/1995 | Burnham | |
| 5,603,171 | A | 2/1997 | Steinkuhler | |
| 6,125,560 | A * | 10/2000 | Beaumont | E02F 5/287 37/344 |
| 6,374,519 | B1 | 4/2002 | Beaumont | |
| 6,390,006 | B1 * | 5/2002 | Sridhar | B63B 25/02 414/141.8 |
| 6,406,510 | B1 | 6/2002 | Burnham | |
| 7,897,831 | B2 | 3/2011 | Birdwell | |
| 8,193,115 | B2 | 6/2012 | Birdwell | |
| 8,708,172 | B2 * | 4/2014 | Kim | B66C 19/002 212/87 |
| 9,223,025 | B2 | 12/2015 | DeBrunner et al. | |
| 9,382,143 | B2 | 7/2016 | Chen | |
| 9,506,218 | B2 | 11/2016 | Manchester | |
| 9,745,715 | B2 | 8/2017 | Horton | |
| 10,000,905 | B2 | 6/2018 | Leverty | |
| 10,287,746 | B1 * | 5/2019 | Wetta | E02F 9/14 |
| 11,828,042 | B2 * | 11/2023 | Crowson | E02F 3/907 |
| 2006/0123671 | A1 * | 6/2006 | Heuvelman | E02F 3/8841 37/345 |
| 2008/0068926 | A1 | 3/2008 | Chambers et al. | |
| 2009/0036728 | A1 | 2/2009 | Birdwell | |
| 2011/0203338 | A1 | 8/2011 | Birdwell | |
| 2013/0139415 | A1 | 6/2013 | Halkyard et al. | |
| 2013/0241263 | A1 | 9/2013 | Jones et al. | |
| 2014/0245930 | A1 | 9/2014 | Chen | |
| 2014/0283421 | A1 | 9/2014 | Manchester | |
| 2016/0244942 | A1 | 8/2016 | Horton | |
| 2018/0051440 | A1 | 2/2018 | Leverty | |
| 2020/0080282 | A1 | 3/2020 | Bath | |
| 2022/0267989 | A1 * | 8/2022 | Warner | E02F 5/287 |

FOREIGN PATENT DOCUMENTS

| | | | |
|---|---|---|---|
| EP | 2644781 | B1 | 6/2016 |
| GB | 2222425 | A | 3/1998 |
| GB | 2315787 | A | 11/1998 |
| JP | 2000318681 | A | 11/2000 |
| WO | WO198907691 | A1 | 8/1989 |
| WO | WO2005002735 | A2 | 1/2005 |
| WO | WO2008062219 | A1 | 5/2008 |
| WO | WO2021242554 | A1 | 12/2021 |

OTHER PUBLICATIONS

Triflow International, "Containerized Solids Control Equipment", pp. 1-4, (2017), Triflow International, Willis, Texas (USA).

Newton Labs, "An Introduction to Newton Labs", pp. 1-51, downloaded from the Internet on or about May 17, 2020, Newton Labs, Seattle, Washington, (USA).

"AN9003—A User's Guide to Intrinsic Safety", retrieved from the Internet Jul. 12, 2017.

Rotech, "RS1-LD Jet Trencher", pp. 1-2, retrieved from the Internet Jan. 20, 2020, Rotech Subsea, Aberdeen, United Kingdom.

Bleier et al., "Low-Cost 3D Laser Scanning in Air or Water Using Self-Calibrating Structured Light", The International Archives of the Photogrammetry, Remote Sensing and Spatial Information Sciences, vol. XLII-2/W3, 2017, pp. 105-112.

WIPO, International Preliminary Report on Patentability, PCT/US2021/032797, pp. 1-10, Nov. 17, 2022.

European Patent Office, Office Action dated Jan. 25, 2024.

Wing Marine LLC, Response file May 16, 2024 to EPO Office Action dated Jan. 25, 2024.

European Patent Office, Office Action dated Jul. 2, 2024.

WIPO, Written Opinion of the International Searching Authority (KIPO), PCT/US2025/011991, pp. 1-6, Apr. 29, 2025.

WIPO, International Search Report (KIPO), PCT/US2025/011991, pp. 1-3, Apr. 29, 2025.

* cited by examiner

MARINE VESSELS AND METHODS OF USING SAME

CROSS-REFERENCE TO RELATED APPLICATIONS

This application is entitled to and claims the benefit of earlier filed U.S. provisional application Ser. No. 63/622,729, filed Jan. 19, 2024, under 35 U.S.C. § 119(e). This application may also be related to applicants' U.S. nonprovisional patent application Ser. No. 18/517,056, filed Nov. 22, 2023, which was a continuation of nonprovisional patent application Ser. No. 17/996,999, filed Oct. 24, 2022, now U.S. Pat. No. 11,828,042, issued Nov. 28, 2023, which is entitled to and claims the benefit of earlier filed U.S. provisional application Ser. No. 63/029,672, filed May 25, 2020, under 35 U.S.C. § 119(e). All of these earlier filed patent applications and patents are explicitly incorporated by reference herein in their entireties.

BACKGROUND INFORMATION

Technical Field

The present disclosure relates to apparatus, vessels, and methods in the marine environment, including, but not limited to, dredging, underwater excavating, seabed trenching, sand wave relocation, pre-trenching, recovery of marine pipelines and cables, removing cover from marine archeological sites, environmentally acceptable disposal of contaminated bottom materials and the like. More particularly, the present disclosure relates to apparatus, vessels, and methods useful for in situ removal of sediment from the water environment for removal or disposal.

Background Art

In our earlier filed '056, '999 and '672 patent applications we disclosed vessels and methods employing a wing dredge suspended from an agile support vessel to move fluidized dredged material to a predetermined extraction area where a second vessel transfers the fluidized material to either a transport barge or to a nearby deposit site. Our '056, '999 and '672 patent applications in particular introduced the concept of material movement as a separate step in the maintenance dredging process and the separation of material movement from extraction (removal from the water) steps. We also disclosed vessels and methods that are effective at relocating large quantities of accumulated sediments in confined areas such as vessel berths, and that reduce or avoid disruptive maneuvering normally required by conventional dredging vessels. Vessels and methods were disclosed that have a settling period between material arrival and extraction pumping during which gravitational settlement of the dredged material creates a denser extraction stream with less water. In certain embodiments, independent collection and extraction processes were disclosed and coordinated to minimize vessel maneuvering and interference between movement and extraction operations, and transforms the collection and extraction of dredged material from the intermittent process typical of traditional mechanical dredging to a continuous process, that are suitable for operation in inland, coastal and offshore waters, and that do not use cutters or teeth to move sediment so integrity of underwater pipelines and cables and the like are not threatened. The vessels and methods disclosed in our previous patent applications suffer minimal disruption due to debris and trash within the sediment being dredged, and with road mobility for access to remote bodies of water (reservoirs), or to aid in rapid response to a distant emergency (for example, hurricane disruption) more rapidly.

Despite the numerous and valuable improvements accomplished in our previous patent applications, there remains a need in the art for pump vessels that are able to compensate for variance to bottom level and contours of the work site. There remains a need for pump vessels having one or more deck-mounted flexible hose racks for holding sections of flexible hose on deck that may be easily and safely added or removed from the pump discharge conduit or other transport medium. There is a further need for such pump vessels having one or more flexible hose section handling cranes on deck. Finally, there is a need for a nonflexible pump discharge piping vessel connected to the flexible hose sections that articulates and moves allowing for various positions of dredged material in a hopper vessel, and various positions of the hopper vessel. The vessels and methods of the present disclosure are directed to one or more of these needs.

SUMMARY

In accordance with the present disclosure, pump vessels and methods of using same are described which reduce or overcome many of the faults of previously known pump vessels and methods.

A first aspect of the disclosure are pump vessels, comprising:

a) a modular, generally rectangular hull that may be disassembled and transported on one or more trucks or shipping containers, the modular hull comprising a deck, a bow, a stern, a port side, and a starboard side;
b) at least one submersible pump on the hull movable between stowed and deployed positions, each of the at least one submersible pumps having a discharge port;
c) a frame on the hull configured to support the at least one submersible pump between the stowed and deployed positions;
d) a winch on the hull configured to move the frame between stowed and deployed positions;
e) a deck-mounted rack on the hull configured to hold lengths (in certain embodiments equal lengths) of rigid or flexible hose or other transport medium;
f) a deck-mounted crane on the hull for adding and/or removing the sections of rigid or flexible hose or other transport medium from the deck-mounted rack; and
g) the lengths of the rigid or flexible hose or other transport medium configured to be connected end to end between the submersible pump discharge port and a nonflexible, articulating discharge pipe (discharging into another vessel or a floating pipeline).

A second aspect of the disclosure is a method comprising:

a) providing a modular, generally rectangular hull that may be disassembled and transported on one or more trucks or shipping containers, the modular hull comprising a deck, a bow, a stern, a port side, and a starboard side;
b) moving at least one submersible pump between stowed and deployed positions, each of the at least one submersible pumps having a discharge port;
c) supporting the at least one submersible pump between the stowed and deployed positions using respective one or more frames;
d) containing lengths of rigid or flexible hose or other transport medium in a deck-mounted rack;

e) removing the lengths of rigid or flexible hose or other transport medium from the deck-mounted rack using a deck-mounted crane; and f) connecting the lengths of rigid or flexible hose or other transport medium end to end between the submersible pump discharge port and a nonflexible, articulating discharge pipe adapted to discharge into another vessel or a floating pipeline.

A third aspect of the disclosure are subsea sediment fluidizer support vessels, comprising:

a) a modular, generally rectangular hull that may be disassembled and transported on one or more trucks or shipping containers, the modular hull comprising a deck, a bow, a stern, a port side, and a starboard side;

b) port and starboard telescoping jib booms secured to the hull and configured to support and move a device known as a Wing Fluidizer™ between stowed and deployed positions, the Wing Fluidizer™ having one or more thrusters for moving sediment;

c) port and starboard electric motorized trolleys movably secured to the respective port and starboard telescoping jibs to assist in moving the Wing Fluidizer™;

d) port and starboard slave trolleys movably secured to the respective port and starboard telescoping jibs to assist in moving the Wing Fluidizer™; and e) electric wire hoists connected to the port and starboard slave trolleys and configured to lift, lower, and/or adjust attitude of the Wing Fluidizer™.

A fourth aspect of the disclosure are methods comprising:

a) providing a modular, generally rectangular hull that may be disassembled and transported on one or more trucks or shipping containers, the modular hull comprising a deck, a bow, a stern, a port side, and a starboard side;

b) providing a device known as a Wing Fluidizer™, the Wing Fluidizer™ having one or more thrusters for moving subsea sediment;

c) supporting and moving the Wing Fluidizer™ between stowed and deployed positions on the modular, generally rectangular hull using port and starboard telescoping jib booms having electric wire hoists affixed thereto;

d) deploying the Wing Fluidizer™ at a first subsea location and adjusting attitude of the Wing Fluidizer™; and e) retrieving and stowing the Wing Fluidizer™ on the modular, generally rectangular hull.

These and other features of the marine vessels and methods of the present disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain marine vessels and methods of the present disclosure may comprise a number of physical components and features but may be devoid of certain optional hardware and/or other features. For example, certain pump vessels may be devoid of one or more thrusters. As another example, pump vessels of this disclosure may be devoid of navigation systems, GPS, or other expensive equipment.

BRIEF DESCRIPTION OF THE DRAWINGS

The manner in which the objectives of this disclosure and other desirable characteristics can be obtained is explained in the following description and attached drawings in which.

Figure 1:
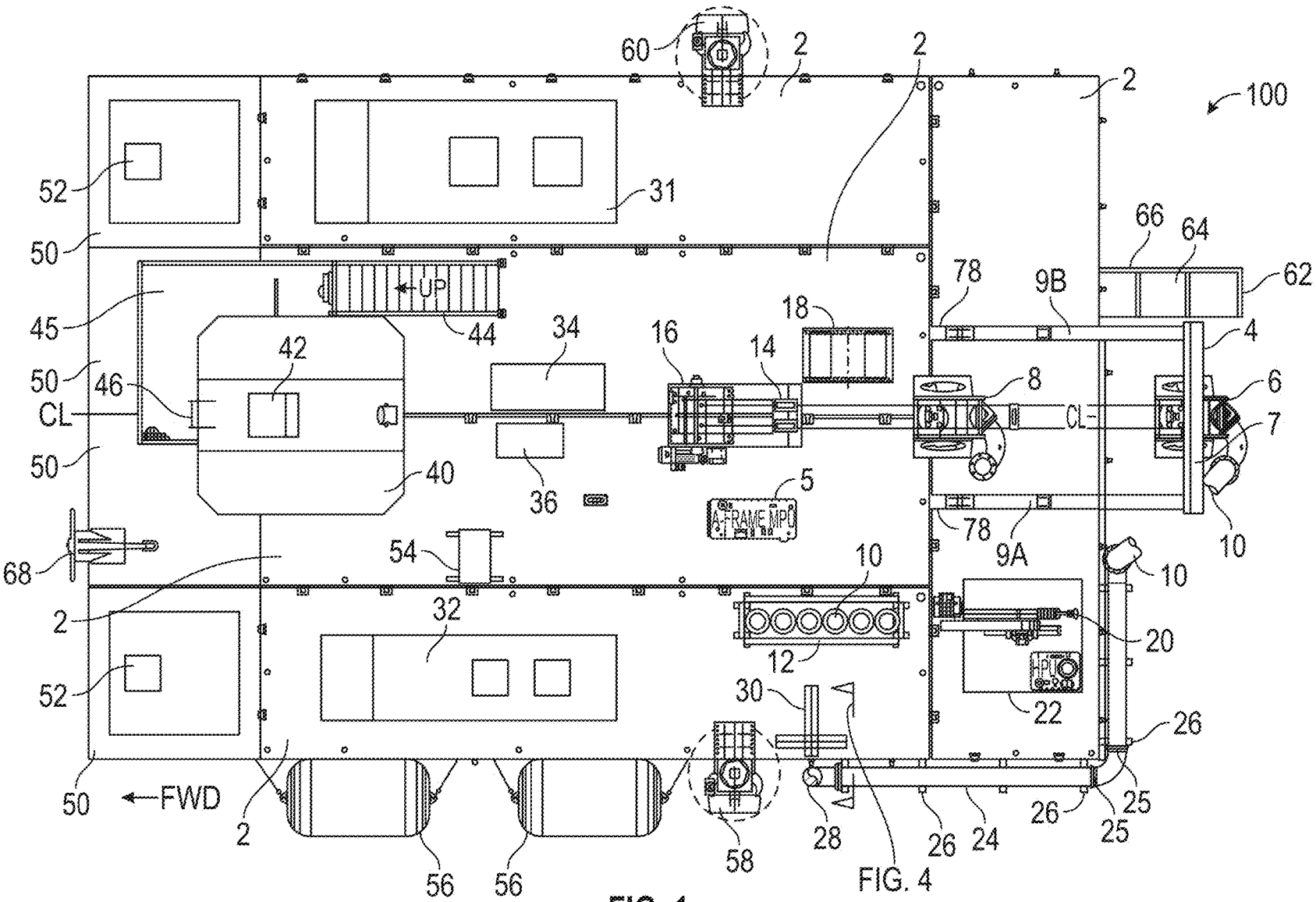
FIG. 1 is a schematic plan view of a single pump embodiment of a pump vessel in accordance with the present disclosure.

It is to be noted, however, that FIGS. 1-10 of the appended drawings may not be to scale and illustrate only typical vessel embodiments, or components of vessels in accordance with this disclosure. Therefore, the drawing figures are not to be considered limiting in scope, for the disclosure may admit to other equally effective embodiments. Identical reference numerals are used throughout the several views for like or similar elements.

DETAILED DESCRIPTION

In the following description, numerous details are set forth to provide an understanding of the disclosed vessels and methods. However, it will be understood by those skilled in the art that the vessels and methods disclosed herein may be practiced without these details and that numerous variations or modifications from the described embodiments may be possible. All published patent applications and patents referenced herein are hereby explicitly incorporated herein by reference, irrespective of the page, paragraph, or section in which they are referenced. Where a range of values describes a parameter, all sub-ranges, point values and endpoints within that range are explicitly disclosed herein. This document follows the well-established principle that the words "a" and "an" mean "one or more" unless we evince a clear intent to limit "a" or "an" to "one." For example, when we state "a wing fluidizer configured to be operable from a first work vessel and comprising one or more thrusters", we mean that the specification supports a legal construction of "a wing fluidizer" that encompasses structure distributed among multiple physical structures, and a legal construction of "a first work vessel" that encompasses structure distributed among multiple physical structures.

The present disclosure describes marine pump vessels, subsea sediment movement assist vessels, and methods for moving fluidized material from one subsea location to another location, and in some embodiments removal of the material from the subsea environment to a disposal or a separation facility.

Certain pump vessel embodiments may comprise multiple submersible pumps and corresponding frames and winches.

In certain embodiments, the deck-mounted rack may be configured to hold equal or different length sections ("lengths") of the flexible and/or rigid hose sections.

In certain embodiments the frame may be mounted adjacent to the stern of the pump vessel.

In certain embodiments the frame may comprise left and right upright support beams connected by a crossbeam on distal ends of the left and right upright support beams.

In certain pump vessel embodiments, the frame may comprise left and right frames and the one or more submersible pumps may comprise left and right submersible pumps, the left frame supporting the left submersible pump and the right frame supporting the right submersible pump.

In certain pump vessel embodiments, the deck-mounted crane may comprise 2 hydraulic boom extensions, or 3 hydraulic boom extensions, or 4 hydraulic boom extensions.

Certain pump vessel embodiments may comprise one or more port-mounted azimuth thrusters, one or more starboard-mounted azimuth thrusters, and/or one or more stern-mounted azimuth thrusters. In certain embodiments, a single vessel may comprise three azimuthal thrusters, using one as a rudder.

In certain pump vessel embodiments, the modular, generally rectangular hull may comprise deck modules each having an effective length of 40 ft, an effective width of 10 ft, an effective depth of 5 ft, a buoyant capacity at 65 percent draft of 27 tons, and a distributed deck bearing capacity of 5,000 pounds per square foot. The deck modules may be of the same or different sizes to facilitate shipping disassembled modular units.

In certain pump vessel embodiments, the articulating hopper discharge pipe may comprise steel sections connected together with swivel flanges.

In certain pump vessel embodiments, the deck-mounted hose rack may comprise a port deck-mounted hose rack and a starboard deck-mounted hose rack.

In certain pump vessel embodiments, the deck-mounted crane may comprise a port deck-mounted crane and a starboard deck-mounted crane.

In certain pump vessel embodiments, the articulating hopper discharge pipe may comprise a port side articulating hopper discharge pipe and/or a starboard side articulating hopper discharge pipe Certain vessel embodiments may comprise one or more umbilicals for powering, controlling, and/or communicating with the one or more pumps or with a wing fluidizer. Certain vessel embodiments may comprise a human-machine interface (HMI). In certain pump vessel embodiments, the pump may be connected to the flexible hose by connectors that may be selected from the group consisting of flange couplings, QC/QDC couplings, cam and groove (CAMLOCK) fittings, and threaded fittings. In certain embodiments the one or more pumps and winches may be wirelessly operated, or only some of these. Certain embodiments may comprise computer-aided maneuvering of the pumps or the wing fluidizer in seven dimensions: pitch (angle of attack), roll, yaw (heading vs. yaw of the service vessel), height above the sediment surface, rotational speed of the impeller, direction and speed of the pump vessel. Certain embodiments may comprise fully automatic computerized operation of the pump and/or wing fluidizer from a separate work vessel.

Certain vessel embodiments may further include one or more computer navigation systems and/or navigation vessels. In certain vessels the navigation vessel may include a global positioning vessel (GPS). In certain embodiments where road/rail mobility may be essential to relocate the entire vessel quickly and inexpensively, the vessel can be broken into modules for transport to remote locations. Such vessels may be used in conjunction with a wing fluidizer or other dredge. During tow to the site; the wing fluidizer would be suspended in the water during tow to gain the lowest possible center of gravity for best vessel stability; this also allows all lifting gear to be low to the water. As mentioned in our '999 application, one strategy for reducing cost may be stockpiling sediment by the device known as the Wing Fluidizer™ or other dredge for later extraction (at environmentally permitted quantities) after the Wing Fluidizer™ is demobilized. In this strategy, the pump vessels of the present disclosure would remain in place throughout the year and could be operated in a totally unmanned condition since there would be no surprises in the stockpiled materials that could lead to disruptions to the pump vessel. Also, the Wing Fluidizer™ would only be recalled when the stockpile required replenishment which could extend cycles of stockpiling beyond an established frequency.

Certain method embodiments may comprise wherein the moving of the at least one pump between stowed and deployed positions, and the supporting of the at least one pump between the stowed and deployed positions using respective one or more frames occurs at the stern of the hull.

Certain method embodiments may comprise wherein the moving of the at least one pump between stowed and deployed positions comprises moving the frame using a winch.

Certain method embodiments may comprise wherein the removing of the sections of flexible hose from the deck-mounted rack using the deck-mounted crane comprises the deck-mounted crane extending with 2 hydraulic boom extensions, or 3 hydraulic boom extensions, or 4 hydraulic boom extensions.

Certain method embodiments may further comprise moving the modular, generally rectangular hull to port using a starboard-mounted azimuthal thruster and/or moving the modular, generally rectangular hull to starboard using a port-mounted azimuthal thruster.

Certain method embodiments may comprise wherein the articulating hopper discharge pipe comprises steel sections connected together with swivel flanges, and the method further comprises moving the articulating hopper discharge pipe into position so that it discharges into a hopper barge.

Certain method embodiments may comprise wherein:

- the deck-mounted rack comprises a port deck-mounted rack and a starboard deck-mounted rack,
- the deck-mounted crane comprises a port deck-mounted crane and a starboard deck-mounted crane,
- the articulating discharge pipe comprises a port articulating discharge pipe and a starboard articulating discharge pipe, and the at least one submersible pump comprises a port pump and a starboard pump, the method further comprising:

removing lengths of rigid and/or flexible hose from the port and starboard deck-mounted racks, connecting the lengths of rigid and/or flexible hose removed from the port side rack between the port pump and the port articulating discharge pipe, and connecting the lengths of rigid and/or flexible hose removed from the starboard side rack between the starboard pump and the starboard articulating discharge pipe.

In certain embodiments the one or more submersible pumps and/or the pump vessel itself may be configured to operate in modes selected from the group consisting of continuous mode and periodic mode. Certain embodiments may comprise a software module including one or more algorithms for calculating parameters selected from the group consisting of volume of dredged materials in a dredged materials hopper, scow, or barge, rate of removal of dredged materials from a target area, rate of accumulation of dredged materials in a trench, topography of dredged materials in the trench, density and/or turbidity of fluidized sediments, maximization of volumes of sediment of different compositions moved, and other environmental conditions that can affect vessel effectiveness, and combinations thereof.

Figure 2:
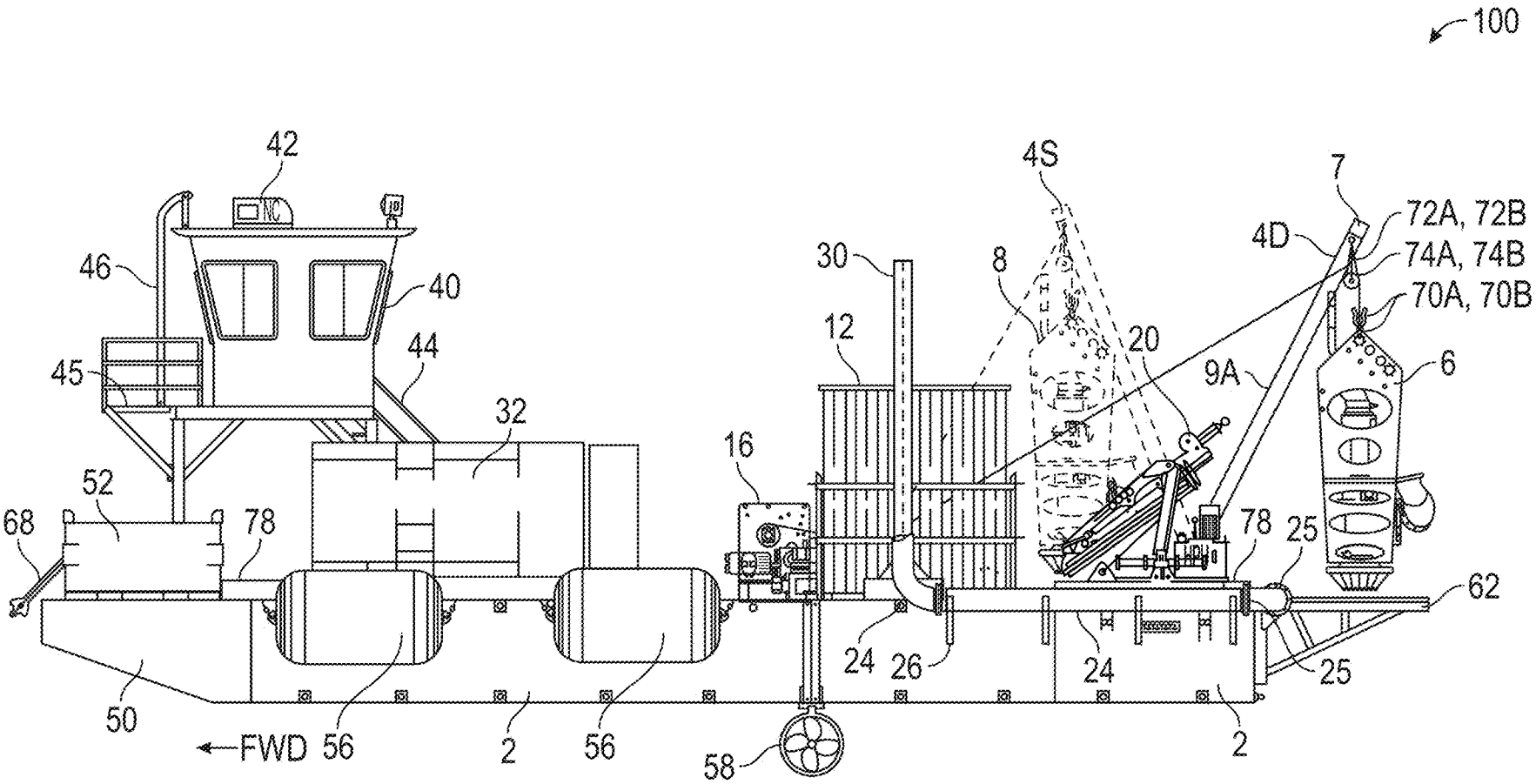
FIG. 2 is a schematic side elevation view of the pump vessel illustrated schematically in FIG. 1, illustrating the deployment frame and pump in deployed position, and the deployment frame and pump in phantom in stowed position.

Referring now to the drawing figures, FIG. 1 is a schematic plan view of a single pump embodiment of a pump vessel 100 in accordance with the present disclosure, while FIG. 2 is a schematic side elevation view of the pump vessel 100 illustrated schematically in FIG. 1, illustrating the deployment frame and pump in deployed position, and the deployment frame and pump in phantom in stowed position.

Vessel embodiment 100 features several barge float modules, 2, coupled together to form a hull. Float modules known under the trade designation S50 Quadrafloat™ (5 total in FIG. 1), available from Robishaw Engineering Inc., Houston, Texas (U.S.A.), may be used, although the present disclosure is not limited to their use. Deployment frame, 4, having a crossbeam 7 and two support beams 7A (port), 7B (starboard), constructed of 10×10 inch square tubular steel, ASTM A500 grade C or equivalent, is secured to float modules 2, typically through skid beams. Deployment frame designated 4D is illustrated boomed out for deployed position, while deployment frame 4S is illustrated as boomed in for stowed position. Deployment frame 4 is operated by a hydraulic pressure unit (HPU), 5.

Deployment frame 4 supports a pump (6 deployed position, 8 stowed position), which may be a JPH 12000 pump available from Eddy Pump Corporation (El Cajon, California, (U.S.A.), a hydraulic cable-deployed pump with 12-inch diameter water jetting agitator, sometimes referred to as a jetting ring, although other pumps may be suitable.

Deployment frame 4 includes a crossbeam 7 supported by upright beams 9A (port) and 9B (starboard). Dual vertical sheaves 14 are provided, along with an electric winch 16, split drum, dual speed motor, on skid, and an umbilical reel 18.

An important feature of pump vessels of the present disclosure is the presence of rigid and/or flexible hose sections 10 (for example, but not limited to, 12 inch diameter, 10 ft lengths) and one or more hose rack 12. In accordance with pump vessels of the present disclosure, hose racks 12 may hold from 4 to 14 hose sections 10, depending on the length of the hose sections, space on the hull, and other considerations. In embodiment 100, hose rack 12 holds six hose sections, each being 12 inch diameter and 10 feet in length.

A hose handling crane 20 is provided (Palfinger PK4501M or equiv.), typically mounted to the hull via a skid 22.

Another important feature of pump vessels of the present disclosure is provisional of a discharge pipe, 24, which may be a 12 inch diameter, SCH80 steel pipe. Sections of discharge pipe 24 may be connected using swivel flanges 25, allowing discharge pipe 24 to be moved to various positions for discharge of sediment into a hopper barge, 80 (FIG. 4) or floatable pipeline (not illustrated). Hopper barges and floatable pipelines are not considered a part of the present disclosure. Pipe supports 26 fixed to barge float modules support discharge pipe 24. Discharge pipe 24 includes a vertical portion 28, supported by a pipe support frame, 30.

Yet another important feature of pump vessels of the present disclosure is provision of azimuthal thrusters 58, 60 on port and starboard sides of the vessels, respectively. More than one thruster may be present on each side, or the stern, of the vessel. Certain embodiments may have thrusters on one side of the vessel only. Other embodiments may have no thrusters. One benefit of thrusters is to improve mobility of the vessel, or in certain embodiments to act as a rudder. Another benefit may be to improve stability of the vessel.

Other features of pump vessel embodiment 100 include, for example, and not limited to:

a generator 31 (for example, 700 kw), a standby generator 32 (for example, 350 kw), an air compressor (for example, 10 HP), with 120 gallon tank, 34, a tool box, 36, an 8 ft.×10 ft. control cabin, 40, having a 10 ft.×10 ft. storage space (below), an air conditioning (AC) unit, 42, a stairway, 44, a horizontal deck grating, 45, a ladder 46 from deck grating 45 to the top of control cabin 40, a plurality of rake modules, 50 coupled together and to float modules 2, one or more fuel storage tanks 52 (for example, 1016 gallons each), one or more electrical switchgear panels, 54, a plurality of pneumatic fenders, 56, a pump access platform, 62, including a grating 64 and handrails 66, and an emergency anchor and slide (for example, 300 pounds), 68.

Figure 3:
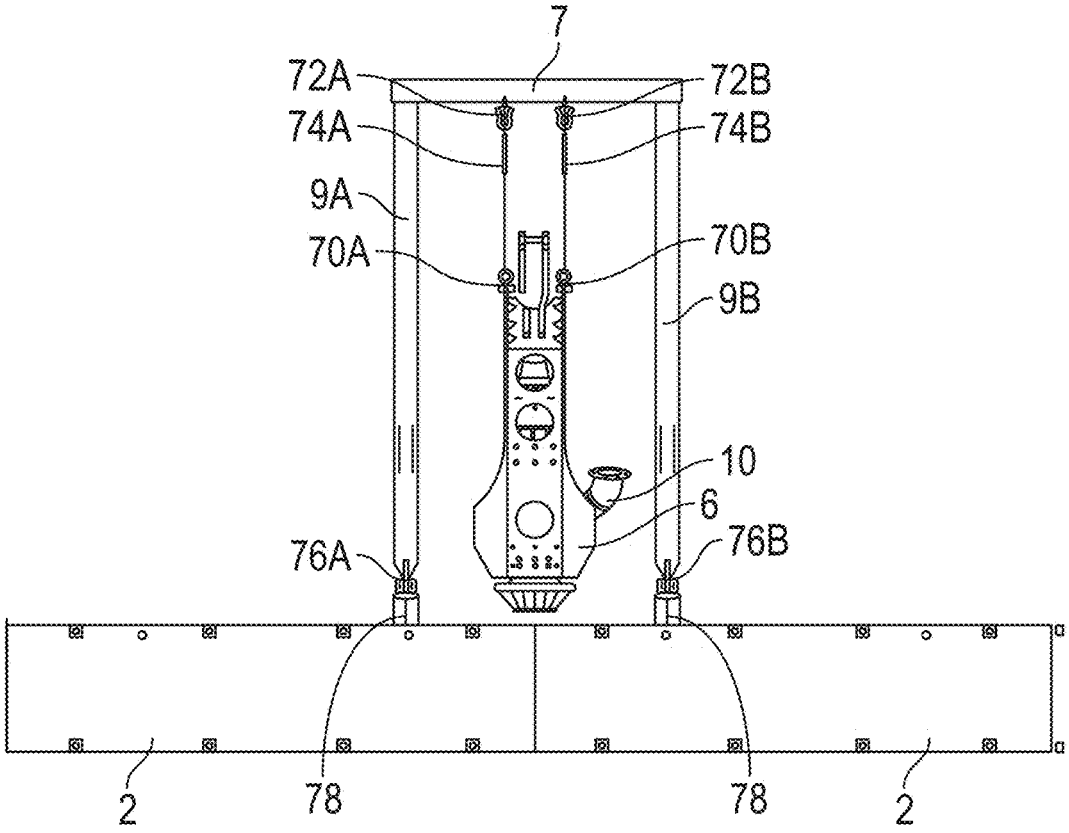
FIG. 3 is a schematic forward-looking elevation view of the deployed deployment frame and pump of the embodiment illustrated schematically in FIGS. 1 and 2.
Figure 4:
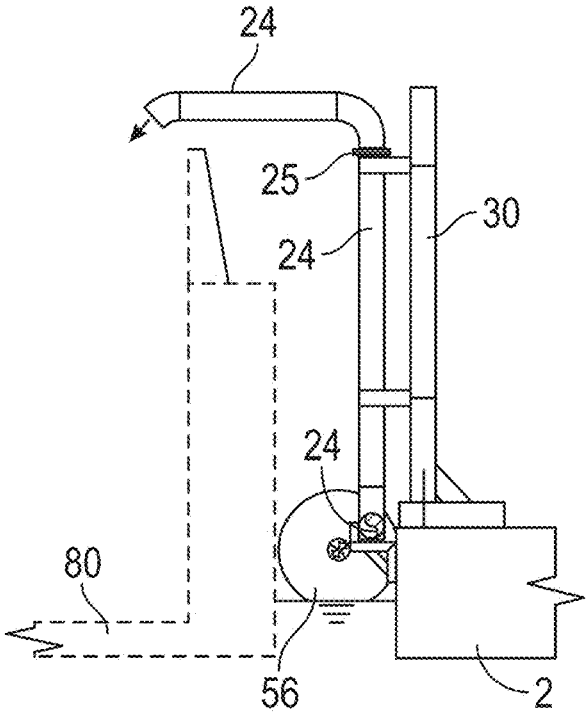
FIG. 4 is a schematic forward-looking side elevation view of a sediment discharge pipe and support of the embodiment illustrated schematically in FIGS. 1-2.

Referring now to FIGS. 2-4, FIG. 2 is a schematic side elevation view of pump vessel embodiment 100 illustrated schematically in FIG. 1, illustrating deployment frame 4D and submersible pump (6, 8) in deployed position (6), and deployment frame 4S and submersible pump 6 in phantom in stowed position (8). FIG. 3 is a schematic forward-looking elevation view of deployment frame 4 and submersible pump 6 of embodiment 100, FIG. 4 is a schematic forward-looking side elevation view of sediment discharge pipe 24 and support 26 of embodiment 100. Lower shackles 70A (port), 70B (starboard) are provided, which may be 1.5 inch 17T shackles, as well as upper shackles 72A, 72B, which may also be 1.5 inch 17T shackles. Two swivel snatch blocks 74A, 74B are further provided, which may be McKissick 12T swivel snatch blocks. Pivot connections (76A port, 76B starboard) are provided to connect deployment frame upright portions 9A, 9B to skid 78. Skid 78 may be 12×78 inch I-beams.

Figures 5, 8:
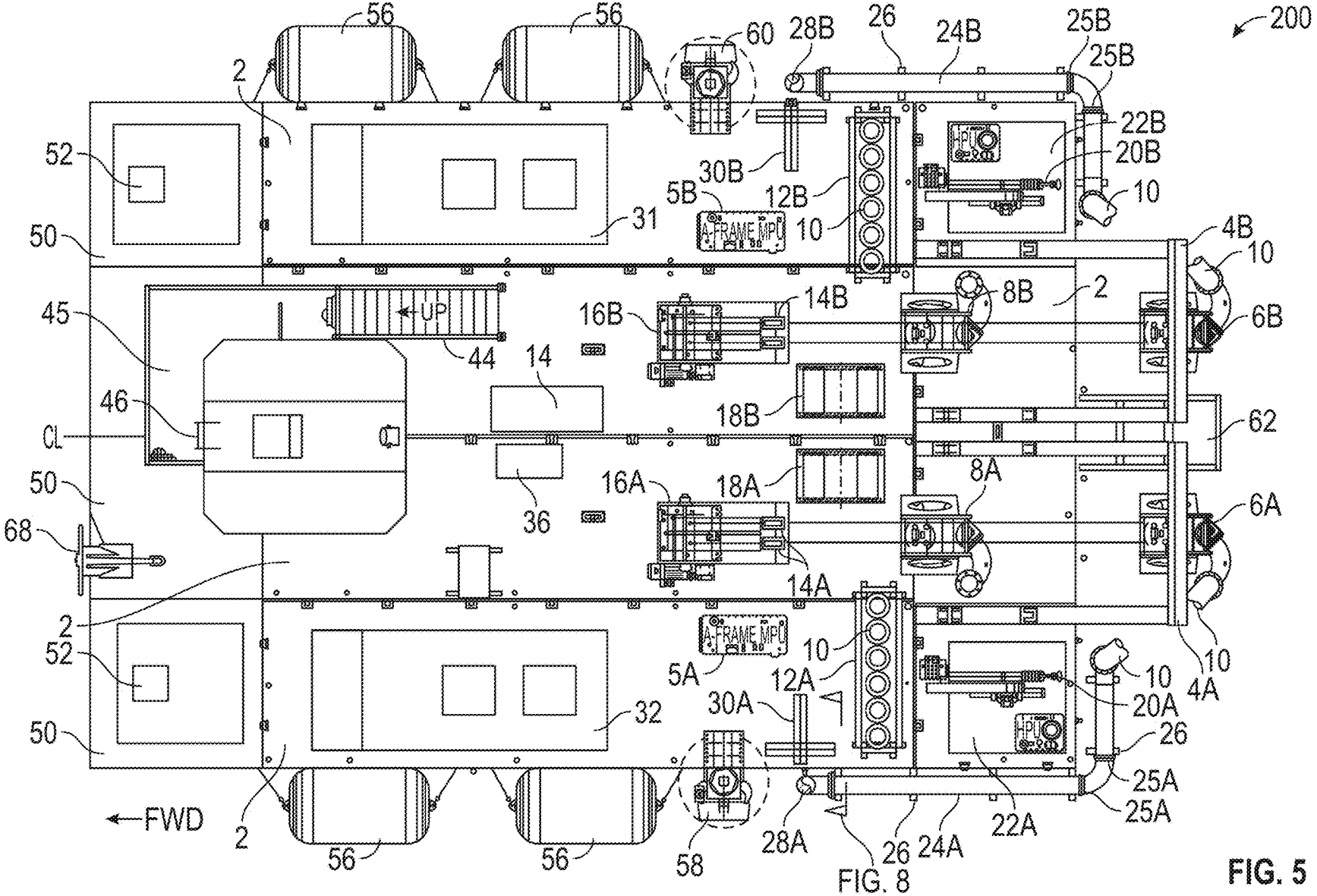
FIG. 5 is a schematic plan view of a dual pump embodiment of a pump vessel in accordance with the present disclosure.
FIG. 8 is a schematic forward-looking side elevation view of a sediment discharge pipe and support of the embodiment illustrated schematically in FIGS. 5-6.
Figure 6:
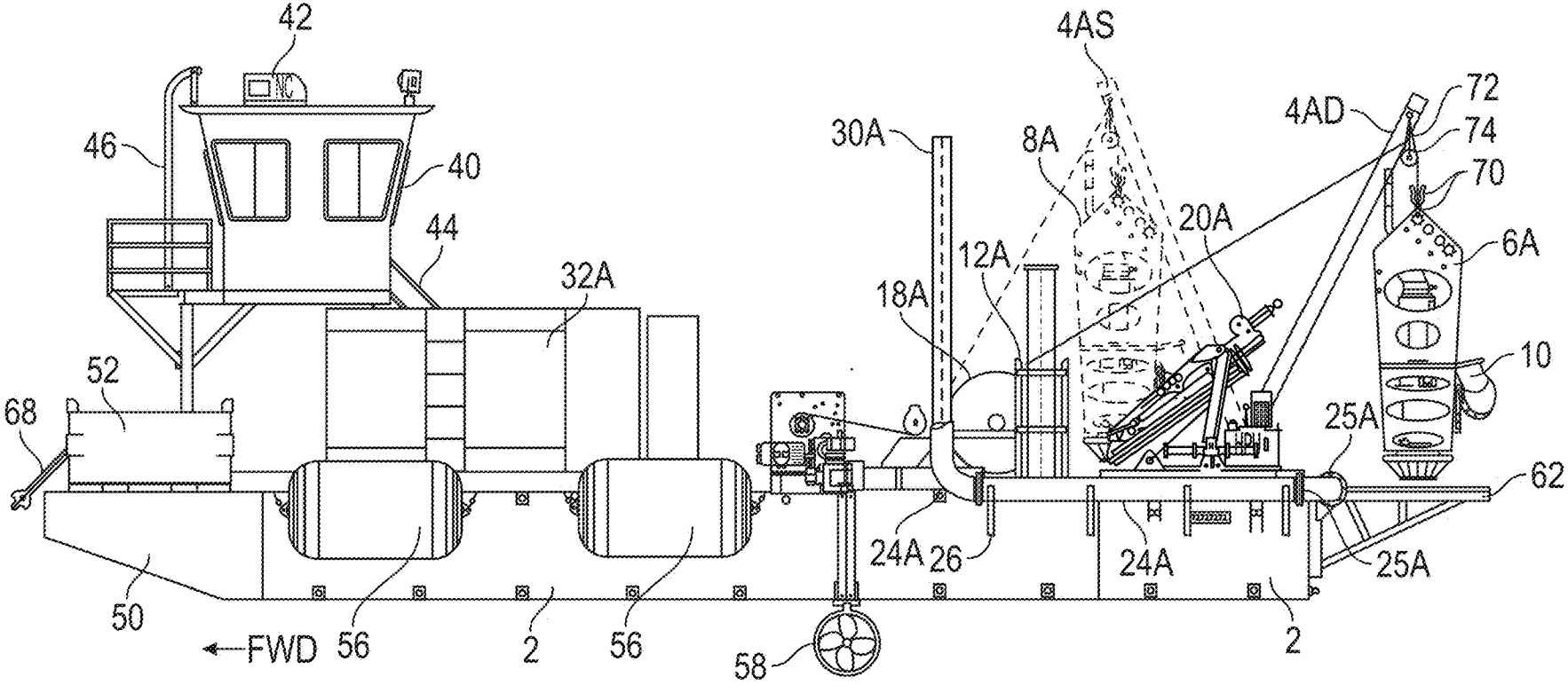
FIG. 6 is a schematic side elevation view of the pump vessel illustrated schematically in FIG. 5, illustrating the port-side deployment frame and pump in deployed position.

Referring now to FIGS. 5-8, FIG. 5 is a schematic plan view of a dual pump embodiment 200 of a pump vessel in accordance with the present disclosure, and FIG. 6 is a schematic side elevation view of pump vessel embodiment 200 illustrated schematically in FIG. 5, illustrating port-side deployment frame 4A and submersible pump 6A in deployed position (6A), and port-side deployment frame 4A and submersible pump 8A in phantom in stowed position (8A). Embodiment 200 features many of the same features as embodiment 100, but with the following differences. Embodiment 200 features two flexible hose racks, 12A, 12B, where "A" generally refers to port, and "B" refers to starboard side of the vessel, unless otherwise noted. Embodiment 200 further features two electric winches 16A, 16B, each being split drum, with dual speed motors, on separate skids. FIG. 6 illustrates deployment frames 4A, 4B in deployed (4AD, 4BD) positions, it being understood that both deployment frames 4A, 4B may be moved to stowed positions. Two deployment frame HPUs are provided, 5A, 5B. Deployment frame 4A includes a crossbeam 7A and two upright support beams, 9AA, 9AB, while deployment frame 4B includes a crossbeam 7B and two upright support beams 9BA, 9BB.

Hose racks 12A, 12B are aligned perpendicularly to hull axis, which differs from the alignment of flexible hose rack 12 in embodiment 100. This is mainly for convenient access by port and starboard hose handling cranes 20A, 20B, which are mounted on skids 22A, 22B, respectively, and is not required in all embodiments. Embodiment 200 features dual vertical sheaves 14A, 14B, dual umbilical reels 18A, 18B, port and starboard steel discharge pipes, 24A, 24B, each having their own swivel flanges 25A, 25B, vertical portions 28A, 28B, and discharge pipe support frames 30A, 30B as illustrated schematically in FIGS. 5 and 6.

Figure 7:
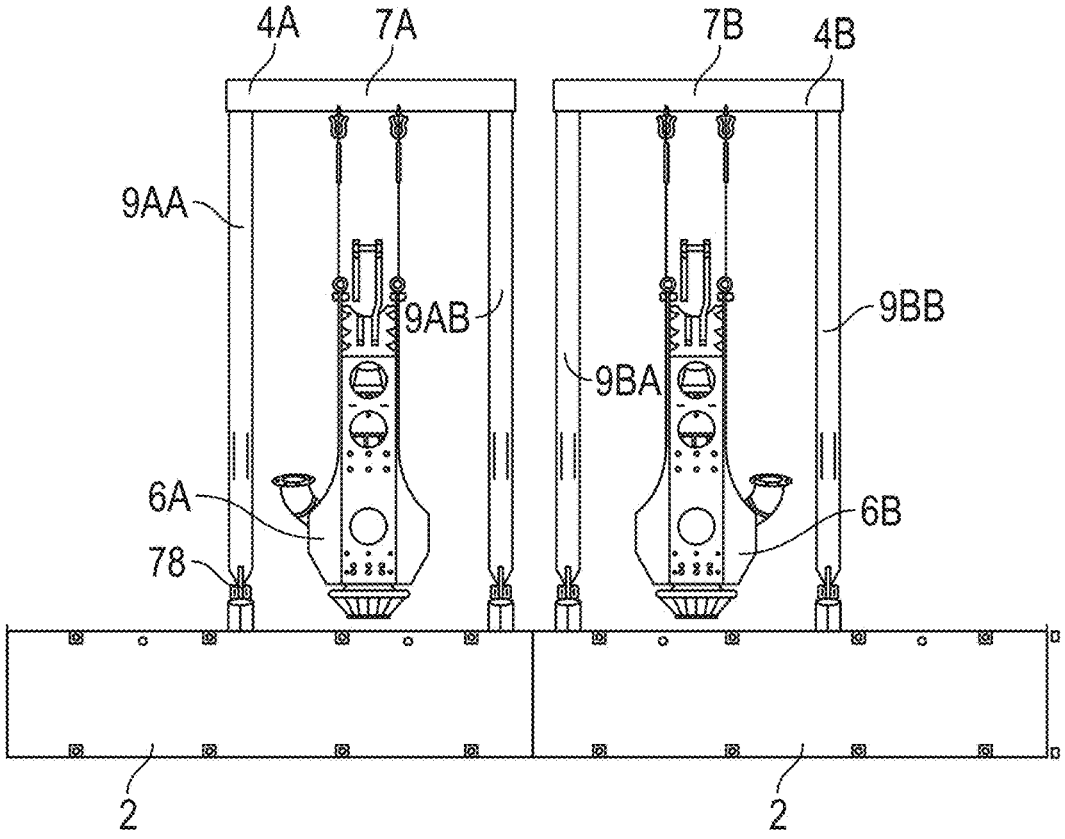
FIG. 7 is a schematic forward-looking elevation view of the deployment frames and pumps of the embodiment illustrated schematically in FIGS. 5 and 6.
Figure 8:
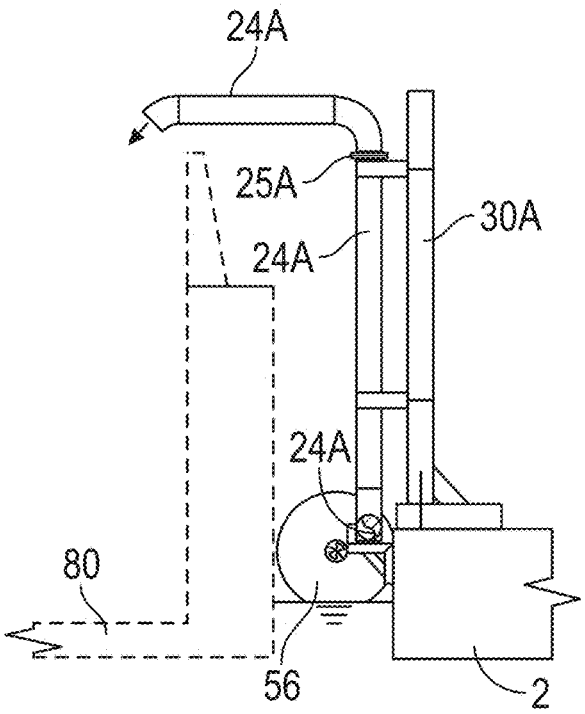

FIG. 7 is a schematic forward-looking elevation view of deployment frames 4A, 4B and submersible pumps 6A, 6B of embodiment 200 illustrated schematically in FIGS. 6 and 7, while FIG. 8 is a schematic forward-looking port side elevation view of sediment discharge pipe 24A and support 26A of embodiment 200. Four sets of lower and upper shackles, and four swivel snatch blocks are further provided (not numbered for clarity) similar to embodiment 100. Pivot connections are provided to connect deployment frame upright portions 9AA, 9AB, 9BA, and 9BB to skid 78. Skid 78 may be 12×78 inch I-beams.

Figure 9:
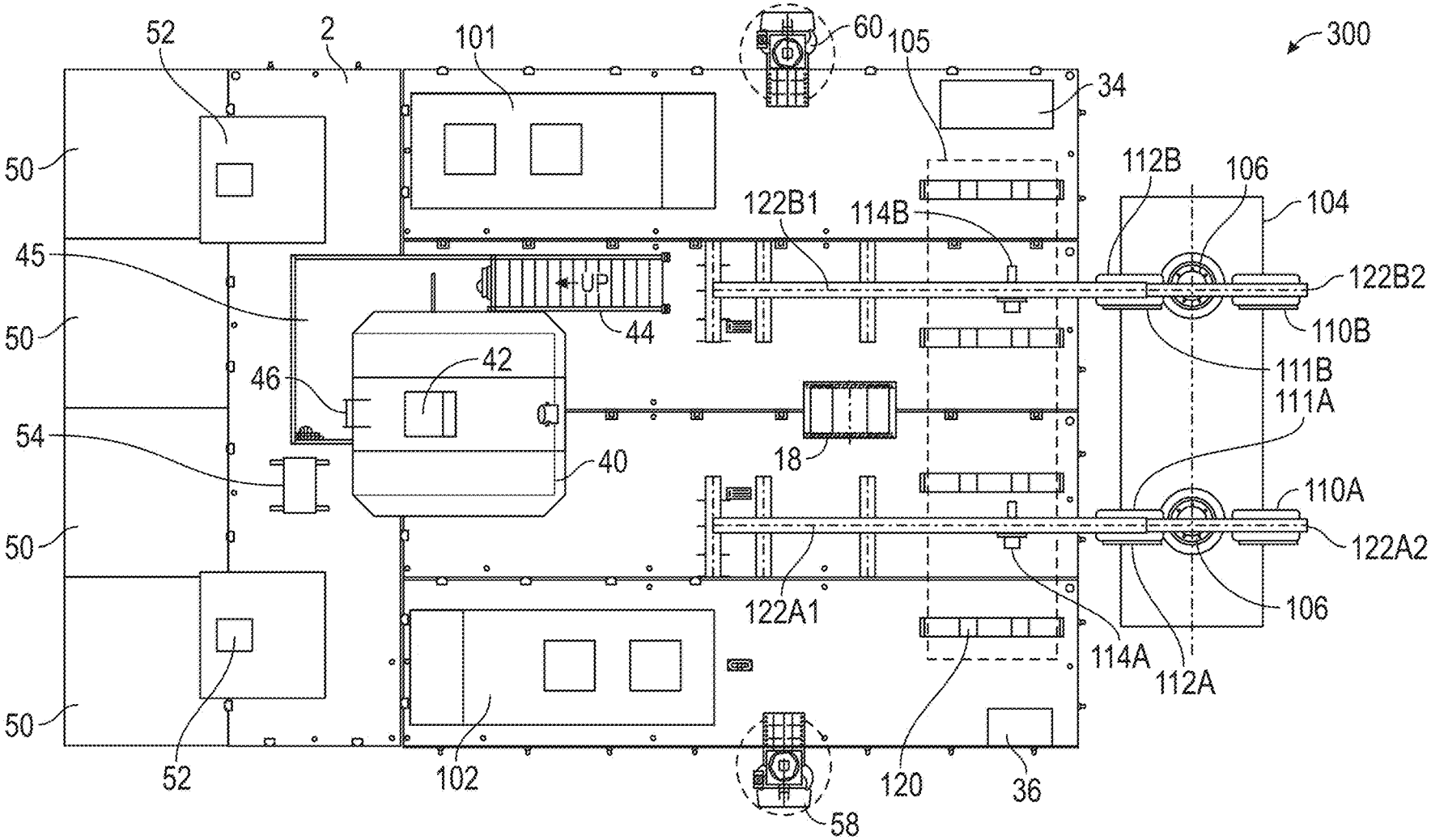
FIG. 9 is a schematic plan view of a Wing Fluidizer™ support vessel in accordance with the present disclosure, illustrating the device known as the Wing Fluidizer™ in deployed position and stowed position (the latter in phantom)
Figure 10:
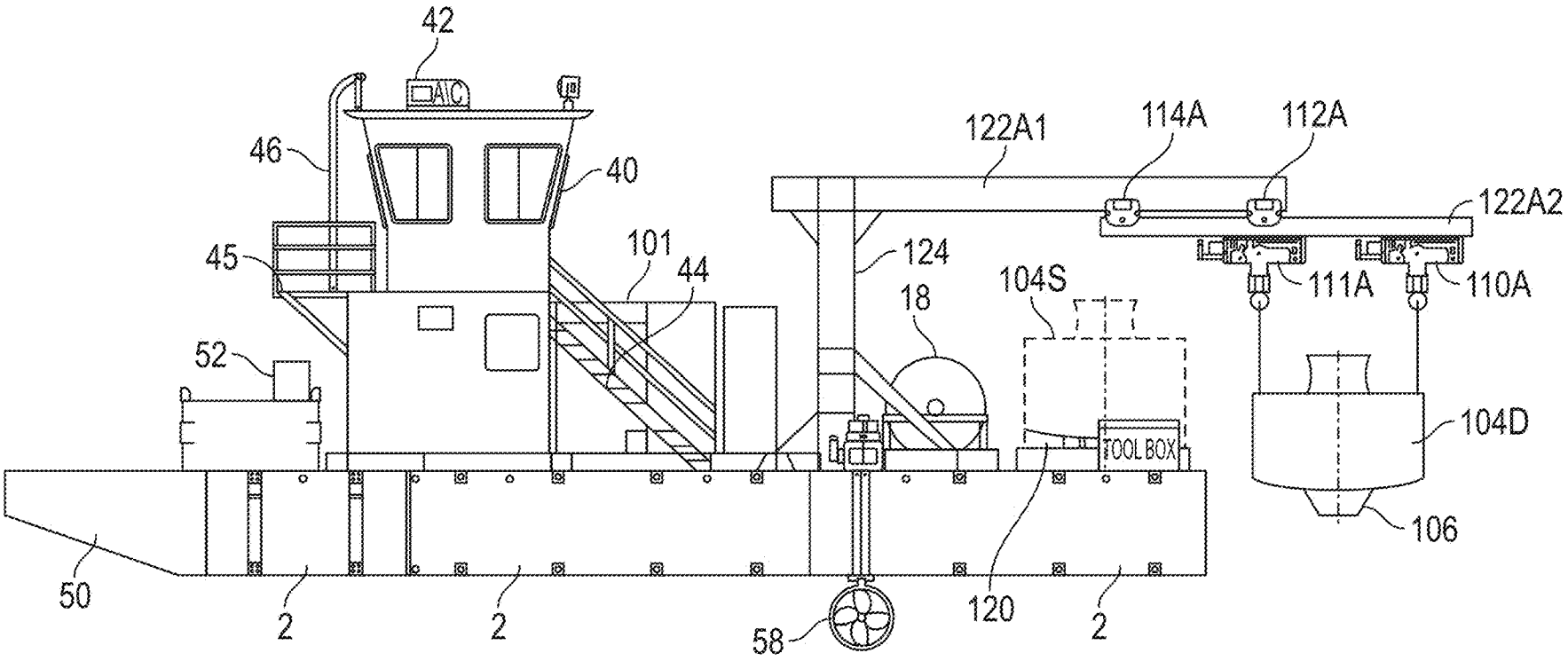
FIG. 10 is a schematic side elevation view of the Wing Fluidizer™ support vessel illustrated schematically in FIG. 9, illustrating the port-side telescoping jib boom and the Wing Fluidizer™ in deployed position, and the Wing Fluidizer™ in phantom in stowed position.

FIG. 9 is a schematic plan view of a wing sediment fluidizer support vessel embodiment 300 in accordance with the present disclosure, and FIG. 10 is a schematic side elevation view of the wing fluidizer support vessel embodiment 300, illustrating a port-side telescoping jib boom 122A and a Wing Fluidizer™ 104 in deployed position (104D), and Wing Fluidizer™ 104 in phantom in stowed position (104S), with thrusters 106. Wing Fluidizer™ 104 footprint (dashed box) is illustrated schematically at 105 (FIG. 9).

Two port (110A, 111A) and two starboard (110B, 111B) electric wire rope hoists are provided in vessel embodiment 300, each being, for example, but not limited to, 5 ton rating each, each with lengths of wire rope sufficient to reach working depth.

Two port (110A, 111A) and two starboard (110B, 111B) electric wire rope hoists are provided. Two port (112A, 114A) and two starboard (112B, 114B) motorized trolleys are further provided in embodiment 300, each having, for example, but not limited to, 10 ton rating each.

A 12×12 inch timber cradle, 120, is provided for stowing wing fluidizer 104S in embodiment 300.

Two telescoping jib booms are provided, a port telescoping jib boom including a flange (122A1), and a flange boom extension 122A2. The starboard telescoping jib boom is not illustrated in FIG. 10 but would also include a flange (122B1) and a flange boom extension (122B2). Each of the two telescoping jib booms are not limited to one boom extension. Each telescoping jib boom is supported by a flange pedestal, 124. The telescoping booms of the Wing Fluidizer™ deployment and recovery cranes in vessel embodiment 300 are each composed of a fixed portion 122A1 (port) and 122B1 (starboard) and a sliding extensible portion 122A2 (port) and 122B2 (starboard). Each extension mechanism is composed of the motorized (aft) drive trolleys 112A and 112B and the (forward) slave roller trolley 114A and 114B. Each trolley will support for example, but not limited to, 10 tons of load.

In embodiment 300, the fixed portion of each telescopic jib boom is composed of a 21×93 inch wide flange beam and each extensible element is a 12×58 inch wide flange beam. The starboard-side telescopic jib boom is not illustrated in FIG. 10 but is also composed of these two major structural members. These dimensions are approximate and may vary with the configuration of the Wing Fluidizer utilized.

Each of the two telescoping jib booms may be composed of more than a single boom extension.

Performance Measurement and Control Systems

Pump Vessel

In certain embodiments, instrumentation located in the pump output stream(s) measures the amount of sediment in the sediment/water slurry in real time. The sediment volume is maximized by raising or lowering the pump in the collection/transfer trench and by increasing or decreasing the vessel speed during each collection cycle.

Wing Fluidizer™ Vessel

A density wave (current) is formed by the water injection action of the Wing Fluidizer™ on the surface of the sediment. The current forms itself into a horizontal column or wave of energized water that is pushed along the sediment surface by the Wing Fluidizer™.

The interface between the density wave and the ambient water is well defined. In certain embodiments, sonar sensors may be mounted on the body of the device known as the Wing Fluidizer™ and/or on the vessel hull and positioned to observe the interface between the density wave and the ambient water body. The height and stability of the wave (and volume of the energized sediment within) may be maximized by one or more of: 1) increasing or decreasing (adjusting) the distance of the Wing Fluidizer™ above the sediment surface; 2) the angle of attack (pitch) of the body of the Wing Fluidizer™; 3) the speed and/or power of the Wing Fluidizer's thrusters; and/or the velocity of the Wing Fluidizer™ support vessel (if present).

A pilot cabin 40 and other equipment, such starboard and port generators 101, 102, are supported by skid beams attached to the float members 2.

The present disclosure describes marine wing fluidizer support vessels, pump vessels and methods for moving fluidized material from one subsea location to another location, and in some embodiments removal of the material from the subsea environment to a disposal, or a separation or upgrading facility. Wing fluidizer support vessels of this disclosure are designed to deploy a Wing Fluidizer™, suspended from a wing fluidizer support vessel of this disclosure, to move the dredged material to a predetermined extraction area where a pump vessel of this disclosure transfers the fluidized material to either a transport barge or to a nearby deposit site. The introduction of material movement as a separate step or feature in the maintenance dredging process and the separation of material movement from extraction (removal from the water) steps are unique features of vessels and methods of the present disclosure. Combinations of multiple wings and support vessels, pumps and support vessels, disposal barges and/or separation vessels may be combined into coordinated vessels and methods of this disclosure to complete various work scopes.

The modularity of the vessels has the following purposes: rapid mobilization (via highway, railroad, or aircraft) between work sites to address emergency situations caused by weather events or vessel issues and requiring clearing of navigation channels. Also, for remediation of inland issues (dam overflows) that can cause flooding of residential areas; to allow access to landlocked work areas, such as reservoirs that require large volumes of sediment extraction; efficient removal/burial of contaminated material released in environmentally sensitive areas or clearing/removal of shoals affecting navigation channels. Due to the presence of separate, sealed compartments the vessels are unsinkable in the event of damage to one or two modules, enhancing crew and vessel safety in congested areas and minimizes the likelihood of a fuel spill or other environmental damage; system downtime due to collision is minimized, since the floatation modules are standard manufactured items and replaceable.

Pumps suitable for use on the single pump vessel and dual pump vessel embodiments may include hydraulically- or electrically-driven submersible extraction pumps that transfer the fluidized material from the collection point to either a hopper barge for transport to a deposit site (conventional dredging) or to a separation plant from which beneficial disposal of the three streams (water, sand and fine grained materials) is initiated, or through reservoir outlets or above/around dams. Suitable submersible extraction pumps may be suspended from a second, independent, work boat to increase the efficiency of the dredged material removal operation and may move the collected materials to deposit areas more than 2,000 feet from the pump intake. If space is available on the wharf, trailers, and/or on separate barges on which the separation and dewatering units may be located there, and if not, the extraction line may be connected to a boost pump to extend the distance between pump and separation plant to lengths limited only by pipeline access ways and project economics, allowing the plant to be positioned in a more beneficial location, perhaps near a rail siding or at a location with easy access to hopper barges for efficient transportation of sand and dewatered fine grain materials to purchasers or to deposit sites. Suitable submersible extraction pumps include, but are not limited to, those known under the trade designation EDDY PUMP available commercially from Eddy Pump Corporation, El Cajon, California. One set of suitable extraction pumps may be those listed in Table 1, available from Eddy Pump Corporation. Submersible pumps known under the trade designation EDDY PUMP may either be electrically or hydraulically driven and may include water jetting ring agitators. Unlike other dredge pumps, pumps known under the trade designation EDDY PUMP do not have an impeller, but instead have a heavy duty geometrically designed rotor that creates a synchronized eddy current similar to a tornado. Pumps known under the trade designation EDDY PUMP can be attached by cable and suspended from a crane, excavator, floating barge with deployment frame or other devices for optimal solids pumping. High chrome versions of pumps known under the trade designation EDDY PUMP exhibit reduced clogging and erosion or downtime associated with maintaining critical tolerances when compared with conventional pumps. The "cable deployed" versions can be fitted with pumps ranging in size from 4-inch through 12-inch discharge size pumps. Production measures at 100-450 cubic yards per hour of material, at distances over 2000-ft. The water jetting ring can be configured in ways to break up most consolidated material while feeding pumps known under the trade designation EDDY PUMP. The Eddy Pump Corporation offers versions with instrumentation allowing monitoring of reach, depth, and GPS location, facilitating precision dredging in real time by allowing an operator to track precisely where they are dredging at all times.

TABLE 1

Extraction Pumps Known Under the Trade Designation EDDY PUMP, Available from the Eddy Pump Corporation (cable deployed, with jetting ring, percentage solids ranging from 40-70 percent)

| Model | Max Flow | Suction Size | Discharge Size | Size of Solids Handled (up to | Cubic Yards of Material/Hr. | |
|---|---|---|---|---|---|---|
| JPH | (gpm) | (in.) | (in.) | inches) | From | To |
| 12000 | 7,000 | 14 | 12 | 11 | 500 | 600 |
| 10000 | 5,000 | 12 | 10 | 9 | 300 | 350 |
| 8000 | 4,000 | 10 | 8 | 7 | 250 | 300 |
| 6000 | 2,000 | 8 | 6 | 5 | 150 | 200 |
| 4000 | 1,200 | 6 | 4 | 3 | 75 | 150 |

Features of vessels and methods of the present disclosure include:

- traditional dredges are single purpose vessels because material collection is merged with extraction; by separating these two processes, vessels and methods of the present disclosure are much more flexible in that the vessels can be used together, or separately, to perform many different tasks in a wide variety of work locations and operating conditions;
- as both pump and wing fluidizer vessels are compact and agile, they are suited for work in restricted areas such as vessel berths, and they can work in close proximity to vessels and to harbor facilities without risk of damage. Also, operations may be suspended with minimal loss to job momentum, minimizing time to complete the job scope;
- vessels and methods of the present disclosure are suitable for operation in inland, coastal (such as the 3,000 mile Intracoastal Waterway in the United States) and offshore waters (offshore operation may require different support vessels and is used primarily for sediment movement and not extraction), and reservoirs (where mobility, operation at depths greater than 100 feet, and ability to unclog lower outlets are of great value);
- water depth is not a constraint.

Vessels and methods of the present disclosure provide an integrated approach to dredging of reservoirs, inland waterways, and port facilities in an environmentally friendly manner. The application of innovative technology improves dredging efficiency and provides opportunities to maintain and improve marginally functioning port facilities at competitive costs. The vessels of the present disclosure are designed to economically address projects where the volume of materials removed may range from about 5,000 to about 60,000 cubic yards but can be used for larger projects (more than 60,000 cubic yards removal).

Vessels and methods of the present disclosure have minimal environmental impact; provide for beneficial use of sediments (for example, beneficial disposal of dredged materials also eliminates dependence on use of limited United States Army Corps of Engineers (USACE) placement capacity); maximize berth availability by efficient removal of dredged materials and by agile marine equipment that can rapidly complete work scopes to allow additional use of the berth; safe for use around wharves, docks, other waterfront structures and pipelines or cables (no blades or teeth); rapid mobilization and demobilization due to road transportable components; cost competitive with traditional dredging methods, allowing the flexibility to economically schedule smaller or emergency projects as required.

As mentioned previously, certain embodiments may include additional Wing Fluidizer™ devices for relocating, and possibly removing, underwater debris (like trees, cars, shopping trolleys and wire ropes) after it is exposed by blowing the covering sediment away. A good example would be grabbers to remove trees that clog up the outlets to reservoirs after sediment is blown away; this is currently performed by divers, which is very expensive and unsafe. Accordingly, certain vessels and methods for small reservoirs and reduced sediment quantities may include one or more of the following features:

- mobilize the critical elements of the vessel to the reservoir (probably the Wing Fluidizer™ and the submersible extraction pump);
- stockpile the specified quantity of sediment into a designated area (possibly against the heel of a dam);
- demobilize those key elements and move them to the next project;
- mobilize a separate, smaller pump spread to the reservoir with the submersible extraction pump size dictated by the maximum quantity of sediment permitted for release downstream per specified period;
- the smaller pump vessel may operate in a programmed robotic mode since the movements would be within the stockpile area only and at predetermined water depths and without any obstructions;
- construct a small permanent base and ramp capable of boat launch and recovery, storing and maintaining the pump and utility boats, and a small administration/warehouse building; also, install USGS sediment measurement facilities to monitor incoming and extracted sediment to provide the reservoir operators and environmental groups relevant data;
- retain the unit at the worksite on a year-round basis using local, specially trained personnel;
- contract for a longer-term period, during which the wing Fluidizer™ and larger submersible extraction pump will return to the reservoir to renew the stockpile of sediment as required.

We believe that vessels and methods of the present disclosure having one or more of these features for small reservoirs and reduced sediment quantities will have the following advantages: potential to avoid periodically defined complete vessel mobilizations; smaller and less expensive vessels for use during long-term maintenance; reduced marine personnel after vessel automation is approved; the personnel will be local and less costly than travelers; the operation will also support the local economy; keeping local workers employed year-round will be only marginally more expensive than hiring temporary employees and training them yearly; another task of the site group would be to maintain the USGS sediment measurement instruments annually; in the long term, permanent facilities will be less expensive than temporary facilities.

Operation of Vessels of the Disclosure

As noted herein, vessels of this disclosure may comprise three major elements:

- The operation of the Wing Fluidizer™ is disclosed in our copending applications and our '042 patent.
- A hydraulically- or electrically-driven submersible extraction pump transfers the fluidized material from the collection point to either a hopper barge or floating pipeline for transport to a deposit site (conventional dredging) or to separation plant having one or more separation units from which beneficial disposal of the three streams or phases (sand, silt, and water) is initiated. The pump is suspended from a pump vessel of the present disclosure to increase the efficiency of the dredged material removal operation. The pump can move the collected material more than 2000 feet from the pump intake and further if a booster pump is inserted in the discharge line. If space is available on adjacent land or on separate moored flat barges, the trailers on which the separation and dewatering units are mounted may be located there, if not, a booster pump may be inserted in the discharge to extend the distance between pump and separation plant allowing the plant to be positioned in an area of lower activity, for example, near a rail siding or at a location with easy access to hopper barges for efficient transportation of sand and dewatered fine grain materials to purchasers or to deposit sites. Alternatively, a rigid discharge system that can articulate using slip flanges may be employed in certain embodiments and used for depth compensation.
- The separation unit (sometimes referred to herein as a separation plant comprising one or more separation units) is also described in our copending patent applications and in our '042 patent.

Other Uses of Vessels of the Disclosure

In addition to precision dredging of port facilities, vessels in accordance with the present disclosure may also be used for:

- levelling sand waves in both sheltered and open waters;
- trenching for and replacing cover over newly installed marine pipelines;
- uncovering existing marine pipelines and cables for repair or removal;
- removal of abandoned pipelines;
- maintaining canal locks and dams;
- removing sediment layers above marine archeological or shellfish bed sites;
- sediment nourishing of intertidal zones, mudflats and marshes;
- environmentally acceptable disposal of contaminated bottom materials;
- salvage (refloating) of grounded vessels;
- with same components reconfigured, extraction of sediments beneath grounded vessels.

It will be understood that the pump vessels and wing fluidizer support vessels need not have the shapes as illustrated in the drawings, but rather could take any shape, such as a box or cube shape, elliptical, triangular, pyramidal (for example, three or four sided), prism-shaped, hemispherical or semi-hemispherical-shaped (dome-shaped), or combination thereof and the like, as long as the vessels are able to serve the functions described herein and be maneuvered as desired. In certain embodiments, the float modules are box-shaped, but this arrangement is not strictly necessary in all embodiments. For example, one or more corners, surfaces, or other features could be arcuate or non-arcuate in shape. It will be understood that such embodiments are part of this disclosure and deemed within the claims. Furthermore, the vessels may be single-hulled, multi-hulled, submersible, semi-submersible, and the like, and the vessels may be ornamented with various ornamentation produced in various ways (for example stamping or engraving, or raised features such as reflectors, reflective tape, patterns of threaded round-head screws or bolts screwed into holes in the collar or collision bumpers), such as designs, logos, letters, words, nicknames (for example WING MARINE, and the like). Hand holds may be machined or formed to have easy-to-grasp features for fingers or may have rubber grips shaped and adorned with ornamental features, such as raised knobby gripper patterns.

From the foregoing detailed description of specific embodiments, it should be apparent that patentable vessels, combinations, and methods have been described. Although specific embodiments of the disclosure have been described herein in some detail, this has been done solely for the purposes of describing various features and aspects of the vessels and methods and is not intended to be limiting with respect to their scope. It is contemplated that various substitutions, alterations, and/or modifications, including but not limited to those implementation variations which may have been suggested herein, may be made to the described embodiments without departing from the scope of the appended claims.

What is claimed is:

1. A subsea sediment fluidizer support vessel, comprising:

a) a modular, generally rectangular hull comprising a plurality of box-shaped float modules coupled together that is configured to be disassembled and transported on one or more trucks or shipping containers, the modular hull comprising a deck, a bow, a stern, a port side, and a starboard side;

b) port and starboard telescoping jib booms secured to the hull and configured to support and move a wing fluidizer between stowed and deployed positions, the wing fluidizer having one or more thrusters for moving sediment;

c) port and starboard electric motorized trolleys movably secured to the respective port and starboard telescoping jib booms to assist in moving the wing fluidizer;

d) port and starboard slave trolleys movably secured to the respective port and starboard telescoping jib booms to assist in moving the wing fluidizer; and e) electric wire hoists connected to the port and starboard slave trolleys and configured to lift, lower, and adjust attitude of the wing fluidizer.

2. The subsea sediment fluidizer support vessel of claim 1 comprising one or more umbilicals for powering, controlling, or communicating with the wing fluidizer.

3. The subsea sediment fluidizer support vessel of claim 1 comprising a human-machine interface.

4. The subsea sediment fluidizer support vessel of claim 1 comprising one or more computers configured to provide computer-aided maneuvering of the wing fluidizer in seven dimensions: pitch, roll, yaw, height above a sediment surface, rotational speed of an impeller, direction and speed.

5. The subsea sediment fluidizer support vessel of claim 1 comprising fully automatic computerized operation of the wing fluidizer from a separate work vessel.

6. The subsea sediment fluidizer support vessel of claim 1 comprising one or more computer navigation systems.

7. The subsea sediment fluidizer support vessel of claim 6 wherein the one or more computer navigation systems includes a global positioning component.

8. A method comprising:

a) providing a modular, generally rectangular hull comprising a plurality of box-shaped float modules coupled together that is configured to be disassembled and transported on one or more trucks or shipping containers, the modular hull comprising a deck, a bow, a stern, a port side, and a starboard side;

b) providing a wing fluidizer, the wing fluidizer having one or more thrusters for moving subsea sediment;

c) supporting and moving the wing fluidizer between stowed and deployed positions on the modular, generally rectangular hull using port and starboard telescoping jib booms having electric wire hoists affixed thereto;

d) deploying the wing fluidizer at a first subsea location; and e) retrieving and stowing the wing fluidizer on the modular, generally rectangular hull.

9. The method of claim 8 comprising powering, controlling, or communicating with the wing fluidizer with one or more umbilicals.

10. The method of claim 8 wherein the moving the wing fluidizer between stowed and deployed positions employs a human-machine interface.

11. The method of claim 8 comprising computer-aided maneuvering of the wing fluidizer in seven dimensions: pitch, roll, yaw, height above a sediment surface, rotational speed of an impeller, direction and speed.

12. The method of claim 8 comprising operating the wing fluidizer automatically from a separate work vessel.

13. The method of claim 8 comprising navigating the modular, generally rectangular hull using one or more computer navigation systems.

14. The method of claim 13 wherein the navigating the modular, generally rectangular hull using one or more computer navigation systems comprises positioning the modular, generally rectangular hull using a global positioning component.

* * * * *